US005733163A

United States Patent [19]

Kim et al.

[11] Patent Number: 5,733,163

[45] Date of Patent: Mar. 31, 1998

[54] SHADOW MASK INCLUDING ELECTRON REFLECTION LAYER AND METHOD FOR MANUFACTURING THE SAME

[75] Inventors: Jae-Myung Kim, Suwon; Hwan-Chul Rho, Kunpo; Hong-Gyu Choi, Suwon, all of Rep. of Korea

[73] Assignee: Samsung Display Devices Co., Ltd., Kyungki-do, Rep. of Korea

[21] Appl. No.: 806,119

[22] Filed: Feb. 25, 1997

Related U.S. Application Data

[63] Continuation-in-part of Ser. No. 499,684, Jul. 7, 1995, abandoned.

[30] Foreign Application Priority Data

Dec. 7, 1994 [KR] Rep. of Korea ..... 94-32111
Dec. 7, 1994 [KR] Rep. of Korea ..... 94-33110

[51] Int. Cl.[6] ..... H01J 29/07

[52] U.S. Cl. ..... 445/47; 313/402

[58] Field of Search ..... 313/402, 408; 445/47, 37

[56] References Cited

U.S. PATENT DOCUMENTS 4,442,376 4/1984 Van Der Waal et al. ..... 313/402
4,983,136 1/1991 Okuda ..... 445/47

*Primary Examiner*—Kenneth J. Ramsey
*Attorney, Agent, or Firm*—Leydig, Voit & Mayer, Ltd.

[57] ABSTRACT

A method for manufacturing a shadow mask including an electron reflection layer on the surface of the shadow mask on which electrons impact. The electron refection layer is formed by spray coating a composition including an inorganic binder and a bismuth ammonium citrate solution containing 10–50 wt % of bismuth, and heat treating the coated shadow mask. The method is simple in application and greatly reduces hole-blocking and thermal deformation of the shadow mask, improving color purity of a reproduced image and enhancing the quality of the image.

14 Claims, 3 Drawing Sheets

SHADOW MASK INCLUDING ELECTRON REFLECTION LAYER AND METHOD FOR MANUFACTURING THE SAME

This application is a continuation-in-part of U.S. patent application Ser. No. 08/499,684, filed Jul. 7, 1995, now abandoned.

BACKGROUND OF THE INVENTION

The present invention relates to a shadow mask including an electron reflection layer and a method for manufacturing the same, and particularly to a shadow mask including an electron reflecting layer with an excellent anti-doming effect and a method for manufacturing the same.

In a color cathode ray tube (CRT), a shadow mask has an array of holes and a constant thickness. The shadow mask is located between a phosphor layer and multiple electron guns, and selectively passes through the holes electrons emitted from the electron guns. The electrons passing through the holes selectively stimulate color phosphors on the panel and emit red, green, and blue light. The shadow mask enables coloring of the reproduced image and is called a color selecting electrode.

When electron beams travel toward the shadow mask of CRT, the electrons that do not pass through the holes collide with the shadow mask. Due to these collisions, the temperature of the shadow mask is increased to about 80°~90° C. The heating causes thermal expansion of a central portion of the mask and a deformation called "doming."

Doming results in a positional shift of the holes of the shadow mask from their original positions, which in turn permits undesired passage of electrons through the position-shifted holes and undesired stimulation of phosphors. When the wrong phosphors are stimulated, the color purity of the reproduced image deteriorates.

The deterioration of color purity due to the thermal deformation of the shadow mask is more serious in larger and higher definition color cathode ray tubes. Accordingly, special shadow masks are used in household-use CRTs twenty five inches in size and larger and in industrial-purpose CRTs fifteen inches in size and larger. In an AK (aluminum killed) mask, the surface facing the electron guns is coated with a material having a high electron reflectivity such as bismuth. Alternatively, an Invar mask which has a low thermal expansion coefficient but is expensive and difficult to process, weld, and treat is used, so that thermal deformation can be reduced.

FIG. 1A is an enlarged view of a shadow mask 2 positioned in a panel 1 including a phosphor layer and FIG. 1B is a detailed view of part of the shadow mask 2. An electron reflection layer 3 coats the surface of the shadow mask 2 facing the electron guns for reflecting electrons that collide with the shadow mask 2.

Generally, the shadow mask coated with the electron reflection layer is manufactured by the following method.

First, fine powders, having a mean diameter of about 1 μm and less, of oxide compounds of metals having high electron reflectivities, such as bismuth, lead, or tungsten, are mixed with water, water glass, a dispersant, a surfactant, etc. to prepare a suspension. This suspension is sprayed on the surface of the shadow mask and dried to form an electron reflection layer (see Korean Patent Publication No. 91-5092). The metal oxides in the electron reflection layer remain in a particle phase. A 20~30% anti-doming effect is obtainable.

However, in this method, the metal oxide powder for forming the electron refection layer is difficult to disperse in a solution. Even when using a fine powder having a mean diameter of 1 μm or less, cohering bodies easily form and clog the spray nozzle, preventing uniform spraying. Moreover, the cohering bodies lead to defects by blocking holes of the shadow mask. It is particularly difficult to apply this method to manufacture industrial cathode ray tubes having fine mask holes (about 120 μm in diameter).

Accordingly, since the AK mask has the described problems, an Invar mask, which has a low thermal expansion coefficient, although it is expensive and difficult to process, weld, and treat, is used for large and higher definition cathode ray tubes.

SUMMARY OF THE INVENTION

An object of the present invention is to provide a method for manufacturing a shadow mask including an electron reflection layer that is free of powder dispersion problems and does not block holes during coating of the shadow mask and that is applicable to higher-definition industrial cathode ray tubes.

Another object of the present invention is to provide a shadow mask including an electron reflection layer with an excellent anti-doming effect.

The object of the present invention is accomplished by a method for manufacturing a shadow mask including an electron reflecting layer, the method comprising:

preparing an electron reflecting layer composition by preparing a bismuth ammonium citrate solution containing 10–50 wt % of elemental bismuth and adding an inorganic binder; and spray-coating the surface of a shadow mask with the electron reflecting layer composition; and heat treating the electron reflecting layer coating.

Another object of the present invention is accomplished by a shadow mask including an electron reflecting layer, formed by the described method.

BRIEF DESCRIPTION OF THE DRAWINGS

The above objects and advantages of the present invention will become more apparent by describing in detail preferred embodiments with reference to the attached drawings in which.

DETAILED DESCRIPTION OF THE INVENTION

In the present invention a bismuth compound having excellent electron reflection characteristics is placed in a solution and applied to a shadow mask to form an electron reflection layer. In other words, to overcome the problems in the conventional method of manufacturing an electron reflection layer using a suspension prepared by dispersing a fine powder in a liquid, a solution containing bismuth, which is a main component of an electron reflection layer composition, is prepared and utilized, thereby forming a good electron reflection layer on the surface of the shadow mask. The solution can be sprayed on one surface of the shadow mask, using an atomizer or a ultrasonic sprayer as well as general spraying methods.

A method of manufacturing a shadow mask according to the present invention is described in detail below.

First, a bismuth ammonium citrate solution containing 10~50 wt % of bismuth is prepared. An inorganic binder, such as a silane derivative, is added to prepare the electron reflection layer composition. The amount of the bismuth ammonium citrate solution is 70 wt % or more based on the weight of the total layer composition.

The silane derivatives preferred in the present invention include, but are not limited to, silane derivatives having alkoxy groups, such as methoxy and ethoxy groups, and amino groups, preferably aminoalkyl groups, such as β-aminoethyl, γ-aminopropyl, N-(β-aminoethyl)-γ-aminopropyl and γ-ureidopropyl groups. Examples of such silane derivatives include γ-aminopropyltriethoxysilane, N-(β-aminoethyl)-γ-aminopropyltrimethoxysilane and γ-ureidopropyltriethoxysilane.

The electron reflection layer composition so prepared contains a bismuth compound as a main component. In the electron reflection layer composition of the present invention, a salt of bismuth is dissolved in a solution. Therefore, to form an electron reflection layer, since a suspension prepared by dispersing bismuth, lead, tungsten, or compounds of all of them in a solution is not used, but a composition having characteristics similar to a solution is used, spraying is very easy.

Figure 1A:
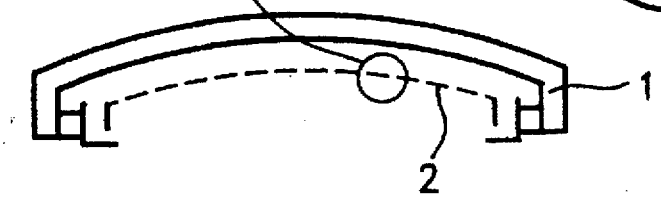
FIG. 1A is an enlarged cross-sectional view of a shadow mask having an electron reflection layer and FIG. 1B is a detailed view of part of FIG. 1A.
Figure 1B:
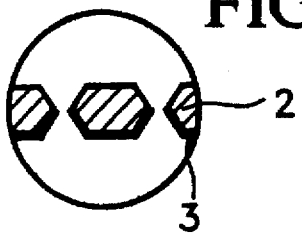
Figure 2:
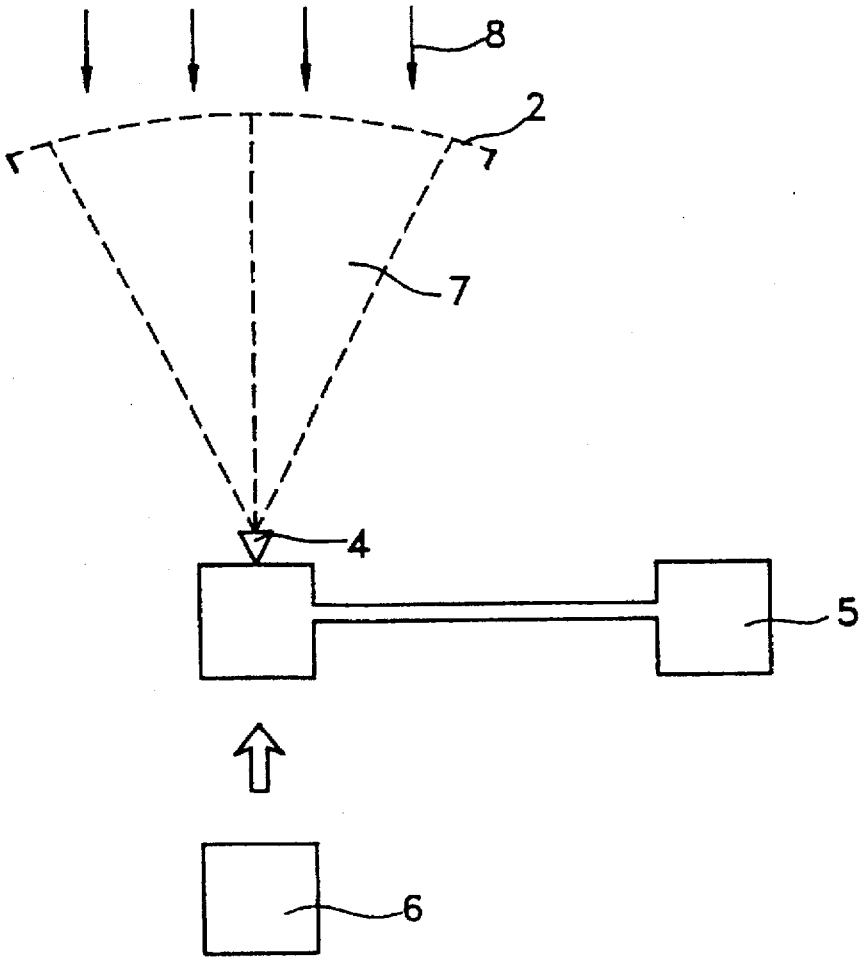
FIG. 2 is a schematic diagram illustrating a process of forming an electron reflection layer on the surface of the shadow mask using an atomizer according to an embodiment of the present invention.

FIG. 2 shows the process of forming an electron reflection layer on the surface of a shadow mask using an atomizer. A composition 5 containing electron-reflective materials and air 6 is employed in the atomizer. The composition is sprayed as an aerosol through the nozzle 4 of the atomizer, and coats the shadow mask surface that will face the electron guns. An air-current supplying equipment 8 blows air opposite the direction of spraying and greatly reduces hole blocking of the shadow mask by the composition during spraying.

Figure 3:
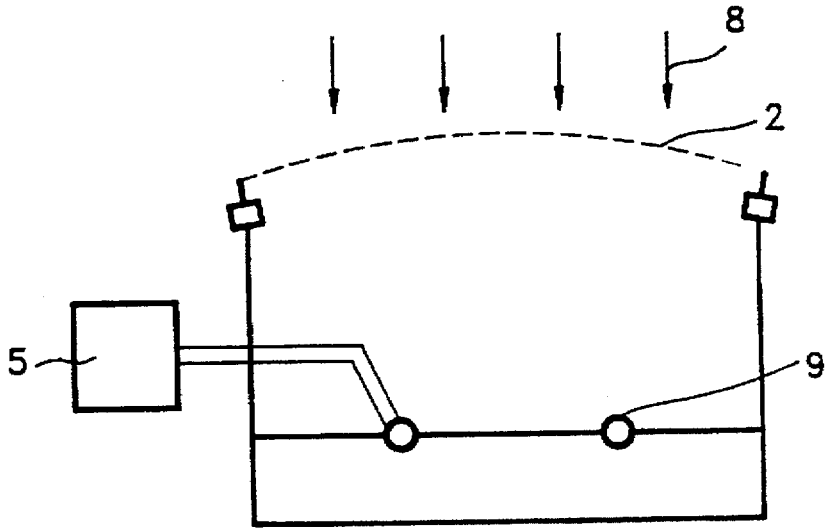
FIG. 3 is a schematic diagram illustrating a process of forming an electron reflection layer on the surface of the shadow mask using a ultrasonic sprayer according to another embodiment of the present invention.

FIG. 3 illustrates a method for manufacturing an electron reflection layer using a ultrasonic sprayer 9. The composition 5 containing the electron-reflection material is employed in the ultrasonic sprayer, and an aerosol is produced, coating the surface of the shadow mask to form the electron reflection layer. It is also preferable that the air-current supplying equipment blow a current of air toward the shadow mask opposite the direction of the aerosol to reduce hole blocking of the shadow mask by the composition during spraying.

Figure 4:
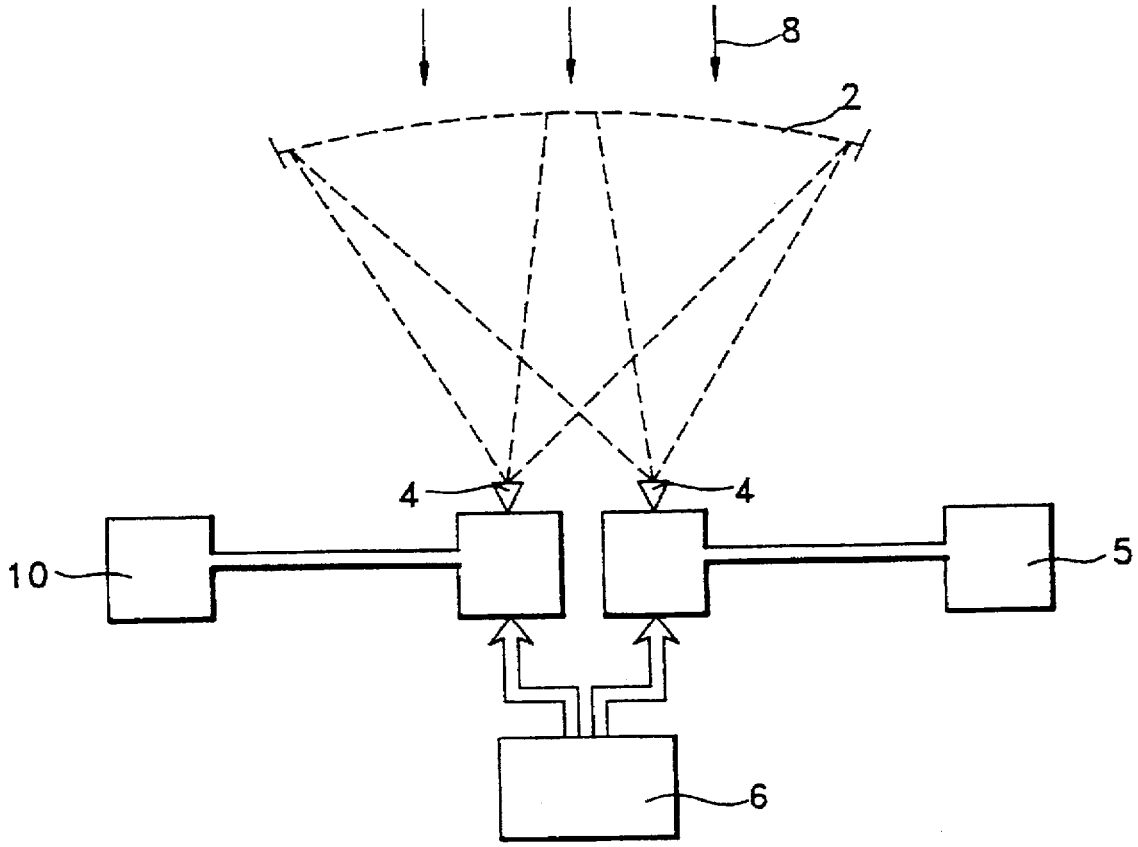
FIG. 4 is a schematic diagram for illustrating a process of forming an electron reflection layer on the surface of the shadow mask using two atomizers according to another embodiment of the present invention.

According to the present invention, a 5~10 wt % solution of potassium silicate preferably sprayed on the surface of the shadow mask that will face the electron gun, during the spray-coating with the electron reflecting layer composition (FIG. 4).

After applying the electron-reflective material to the surface of the shadow mask, the material is oxidized in a heat-treatment at about 400° C., to complete the electron reflection layer. However, when manufacturing a cathode ray tube, since a temperature of about 450° C. is used while sealing a panel to a funnel with frit, no separate heat treatment is necessary.

Through repeated experiments by the inventors, it was confirmed that the electron reflection efficiency is better if the electron reflection layer is thicker. A thick layer can be manufactured by repeated spraying steps. The total thickness of the electron reflection layer is not limited. However, the preferred range is 0.1~20 μm, considering the electron reflection effect and efficiency of the layer. After examining an electron reflection layer, it was confirmed that the particles forming the layer are very fine and have a size within a range of 0.01~1 μm. The layer has a network structure. An electron reflection layer manufactured by the conventional method has a particle structure. The network structure is sturdier than the particle structure.

Figure 5A:
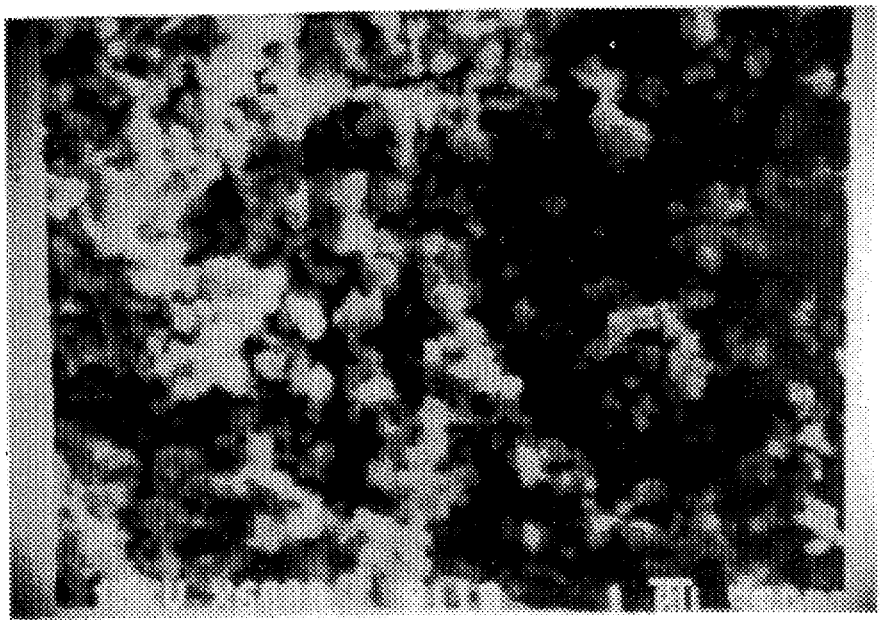
FIGS. 5A and 5B are photographs showing the structure of an electron reflection layer formed according to the conventional method (FIG. 5A) and according to the present invention (FIG. 5B).
Figure 5B:
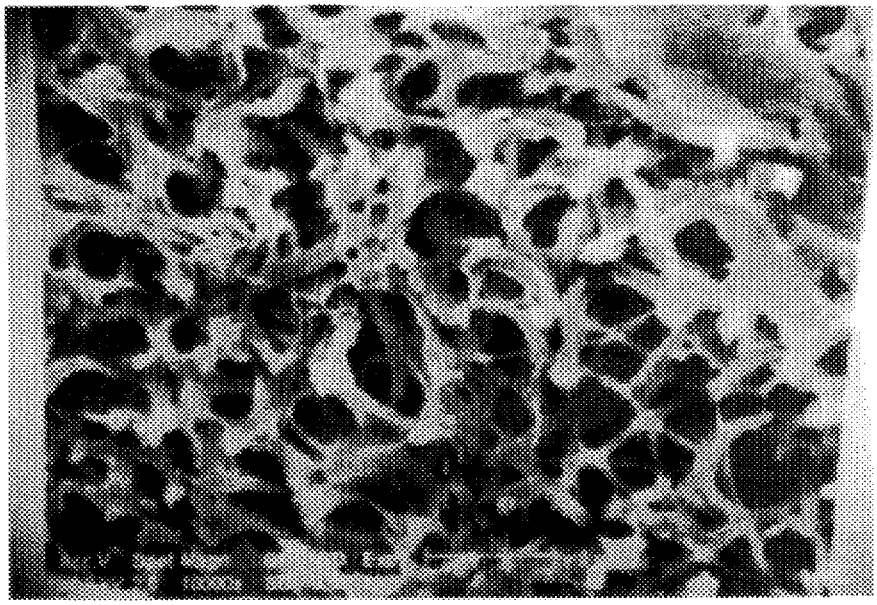

FIGS. 5A and 5B are photographs showing the structure of a conventional electron reflection layer (FIG. 5A) and an electron reflection layer according to the present invention (FIG. 5B). In the conventional method, since a suspension is used as the electron reflection layer composition, cohering bodies are easily formed and the resulting coating is coarse. In contrast, since an electron reflection layer composition having characteristics similar to a solution is used in the present invention, cohering bodies are not easily formed and the coating is fine, i.e., is not coarse. Accordingly, an electron reflection layer according to the present invention has a network structure as indicated in FIG. 5B.

As indicated by comparing FIG. 5A with FIG. 5B, since a shadow mask including an electron reflecting layer according to the present invention has a fine structure, its electron reflection characteristic is excellent.

Preferred embodiments of the present invention will be described in detail below.

EXAMPLE 1

First, 20 g of citric acid was added to 10 g of 10 wt % ammonium hydroxide solution at room temperature. To this solution, 40 g of bismuth nitrate hydrate ($Bi(NO_3).5H_2O$) was added and dissolved and drops of 10 wt % ammonium hydroxide solution were added until the pH of the mixture became about 7. Thereafter, 2 g of N-(β-aminoethyl)-γ-aminopropyltrimethoxysilane (Nippon Unica Co., A-1120) was added to produce an electron reflection layer composition.

The electron reflection layer composition was placed in an atomizer, and air was injected to spray the composition as an aerosol through the nozzle of the atomizer and form an electron reflection layer on an AK mask for a fourteen inch 0.28D color CRT. During the spraying, a current of air was applied toward the shadow mask opposite the spraying direction, using air-current supplying equipment. After coating the surface of the shadow mask with the electron-reflective material, the coating was heat-treated at about 450° C. to complete the shadow mask including the electron reflection layer.

The amount of thermal drift of the shadow mask manufactured was measured to determine its anti-doming effect. From the result, it was confirmed that the doming of the shadow mask was reduced by about 40% compared with a shadow mask having an electron reflection layer formed by the conventional powder spray method. This means that the color purity and image quality of a CRT including the electron reflection layer are improved.

EXAMPLE 2

First, 10 g of citric acid was added to 10 g of pure water at room temperature. To this solution, 20 g of bismuth nitrate hydrate ($Bi(NO_3).5H_2O$) was added and dissolved and drops of 28 wt % ammonium hydroxide solution were added until the pH of the mixture became about 7. Thereafter, 1.5 g of N-(β-aminoethyl)-γ-aminopropyltrimethoxysilane (Nippon Unica Co., A-1120) was added to produce an electron reflection layer composition.

A shadow mask including the electron reflection layer according to the present invention was manufactured by the same procedure as described for Example 1. The anti-doming effect of the shadow mask was measured. It was confirmed that the doming of a shadow mask was reduced by about 32% compared with the shadow mask having an electron reflection layer formed by the conventional powder spray method.

EXAMPLE 3

The electron reflection layer composition was produced and a shadow mask including the electron reflection layer of the present invention was manufactured using the same procedure as employed in Example 1, except that 7% of potassium silicate solution was sprayed through the nozzle of the atomizer on an AK mask during the spraying of the electron-reflecting material composition (FIG. 4). The anti-doming effect was measured and it was confirmed that the doming of a shadow mask was reduced by about 45% compared with the shadow mask having an electron reflection layer formed by the conventional powder spray method.

As indicated in the Examples, the thermal deformation rate of a shadow mask including the electron reflection layer manufactured by the method of the present invention is much less than that of a shadow mask having an electron reflection layer manufactured by the conventional powder spray method. Moreover, hole-blocking during the manufacturing process is greatly reduced, and an AK mask can be applied to a large or high definition cathode ray tube. Therefore, an Invar mask applied in an industrial cathode ray tube can be replaced with a shadow mask according to the present invention, so that a cost reduction is realized. Furthermore, since the electron reflection layer according to the invention is manufactured by spraying a composition similar to a solution instead of a suspension, the manufacturing process is very simple and can be advantageously employed in a production line.

What is claimed is:

1. A method for manufacturing a shadow mask including an electron reflecting layer comprising:

preparing an electron reflecting layer composition by preparing a bismuth ammonium citrate solution containing 10–50 wt % of elemental bismuth and adding an inorganic binder to the bismuth ammonium citrate solution;

spray-coating a surface of a shadow mask with the electron reflecting layer composition; and heat treating the shadow mask with the electron reflective layer coating.

2. The method claimed in claim 1 wherein the inorganic binder is a silane derivative.

3. The method claimed in claim 2 wherein the silane derivative is a member selected from the group consisting of γ-aminopropyltriethoxysilane, N-(β-aminoethyl)-γ-aminopropyltrimethoxysilane, and γ-ureidopropyltriethoxysilane.

4. The method claimed in claim 1 including adding not less than 70 wt % of the bismuth ammonium citrate solution, based upon the total weight of the composition, to the inorganic binder.

5. The method claimed in claim 1 including spray-coating with an atomizer.

6. The method claimed in claim 1 including spray-coating with an ultrasonic sprayer.

7. The method claimed in claim 1 including blowing a current of air toward the shadow mask in a direction opposite the direction of spray-coating of the electron reflecting layer composition.

8. The method claimed in claim 1 including spraying a 5~10 wt % potassium silicate solution on the shadow mask while spray-coating the shadow mask with the electron reflecting layer composition.

9. A shadow mask including an electron reflecting layer wherein the electron reflecting layer is formed by the method claimed in claim 1.

10. The shadow mask claimed in claim 9, wherein the electron reflecting layer includes particles with a size of 0.01~1 μm and has a network structure.

11. The shadow mask claimed in claim 9, wherein the electron reflecting layer has a thickness of 0.1~20 μm.

12. A shadow mask including an electron reflecting layer wherein the electron reflecting layer is formed by the method claimed in claim 7.

13. The shadow mask claimed in claim 12, wherein the electron reflecting layer includes particles with a size of 0.01~1 μm and has a network structure.

14. The shadow mask claimed in claim 12, wherein the electron reflecting layer has a thickness of 0.1~20 μm.

* * * * *